US009316080B2

(12) United States Patent
Larson

(10) Patent No.: US 9,316,080 B2
(45) Date of Patent: Apr. 19, 2016

(54) TORSIONAL SHEARING OF OILFIELD TUBULARS

(75) Inventor: Eric Dale Larson, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 722 days.

(21) Appl. No.: 13/564,892

(22) Filed: Aug. 2, 2012

(65) Prior Publication Data

US 2014/0034316 A1 Feb. 6, 2014

(51) Int. Cl.

| | |
|---|---|
| ***E21B 29/00*** | (2006.01) |
| ***E21B 29/08*** | (2006.01) |
| ***E21B 33/06*** | (2006.01) |

(52) U.S. Cl.

CPC ..... *E21B 29/08* (2013.01); *E21B 33/063* (2013.01)

(58) Field of Classification Search

CPC ..... E21B 29/00; E21B 29/08; E21B 33/063; B23D 21/04; B23D 21/00; B23D 21/003

USPC ..... 30/96

See application file for complete search history.

(56) References Cited

U.S. PATENT DOCUMENTS

| | | | | |
|---|---|---|---|---|
| 3,418,874 A * | 12/1968 | Lees | | 83/456 |
| 5,284,209 A | 2/1994 | Godfrey | | |
| 5,400,857 A * | 3/1995 | Whitby et al. | | 166/297 |
| 7,367,402 B1 | 5/2008 | Bangert | | |
| 2013/0081823 A1* | 4/2013 | Wood | | 166/373 |

FOREIGN PATENT DOCUMENTS

| | | |
|---|---|---|
| WO | 2006051317 A1 | 5/2006 |
| WO | 2011148190 A2 | 12/2011 |

OTHER PUBLICATIONS

International Search Report and Written Opinion issued in connection with corresponding PCT Application No. PCT/US2013/053326 on Jul. 17, 2014.

* cited by examiner

*Primary Examiner* — Cathleen Hutchins
(74) *Attorney, Agent, or Firm* — Bracewell LLP

(57) ABSTRACT

A shearing device that torsionally shears an oilfield tubular by gripping the tubular at vertically spaced apart locations and exerting a torsional force at the locations. Tong assemblies are provided for gripping the tubular, where the tong assemblies include a tong member pivotally mounted on a tong arm. The tong assemblies may be housed in a blowout preventer mounted on a wellhead assembly; projecting the tong assemblies radially inward engages the tong members with the tubular, and moving the arm further radially inward imparts the torsional force onto the tubular. In an alternate embodiment, the shearing device includes holding rams that project radially inward to engage the tubular and a torque rack that tangentially engages the tubular thereby torqueing the tubular.

16 Claims, 6 Drawing Sheets

FIG. 1B
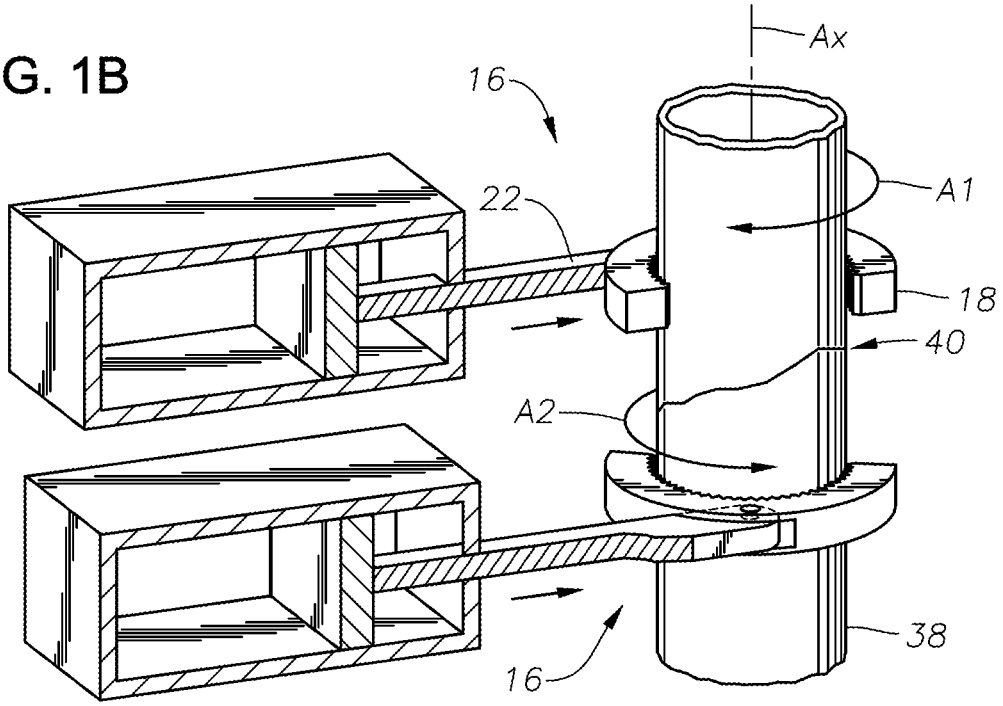
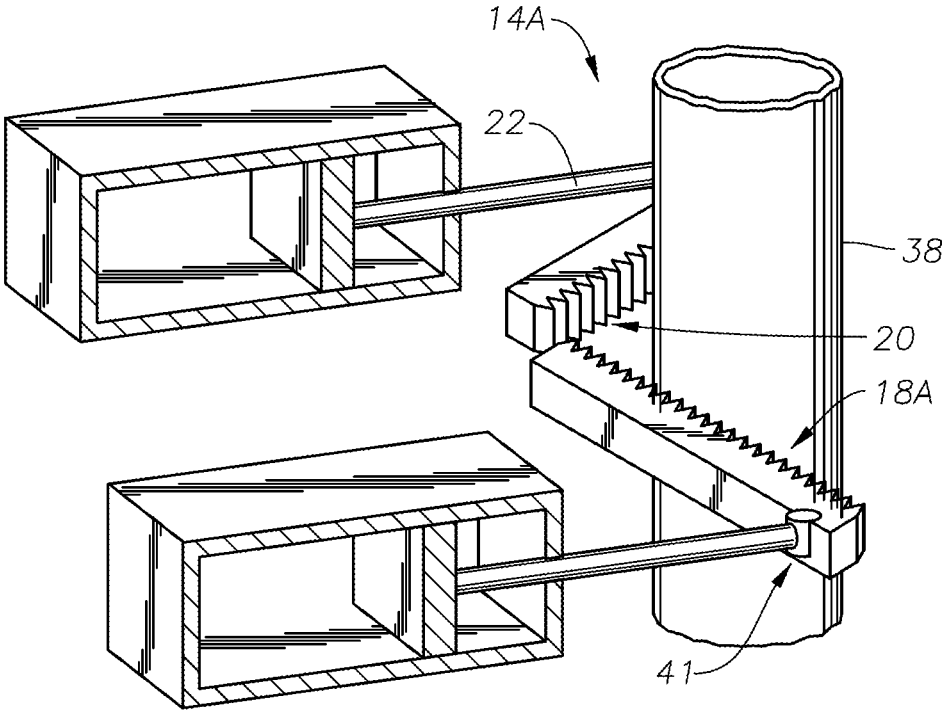
FIG. 2

FIG. 4A
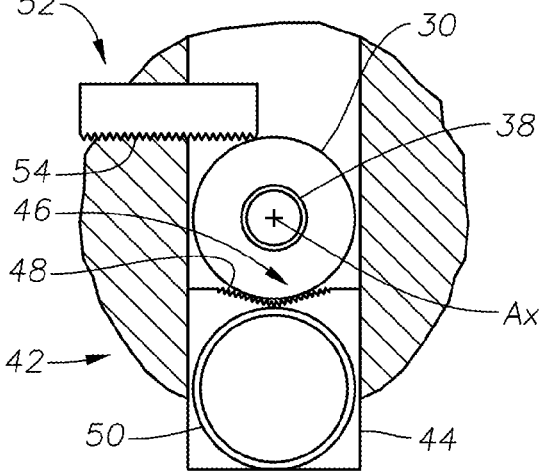
FIG. 4B
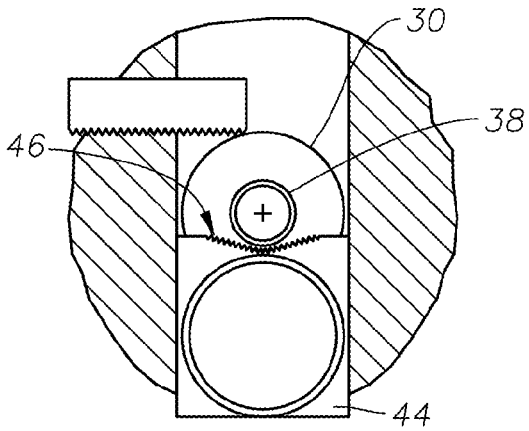
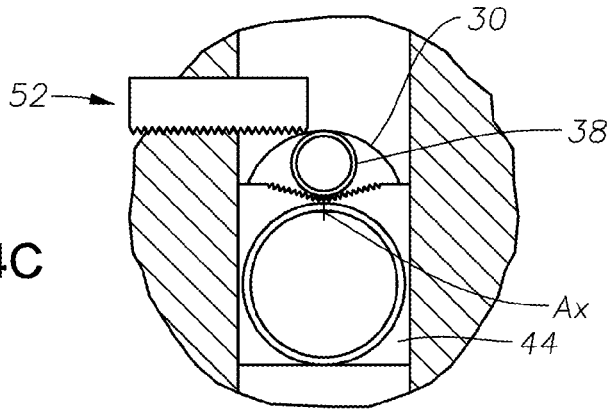
FIG. 4C
FIG. 4D
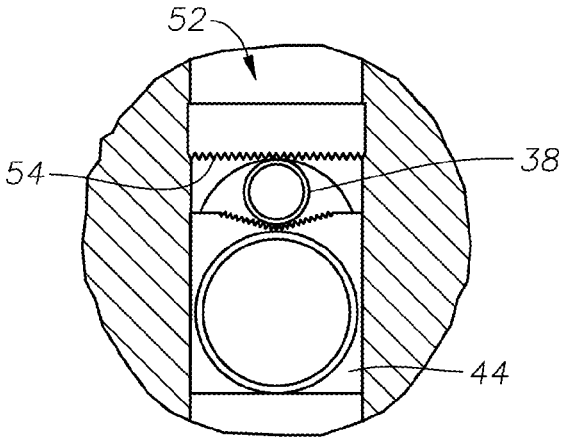
FIG. 4E
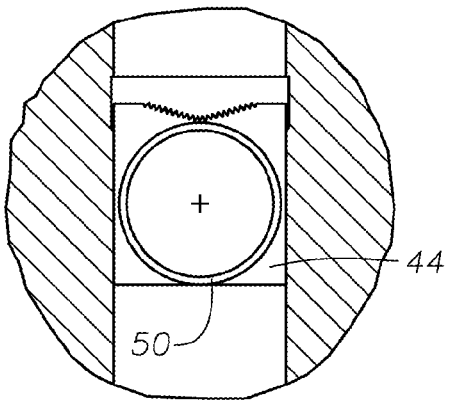

TORSIONAL SHEARING OF OILFIELD TUBULARS

BACKGROUND

1. Field of Invention

The present disclosure relates in general to an apparatus and method for fracturing an oilfield tubular.

2. Description of Prior Art

Drilling a wellbore for production of oil and/or gas typically involves inserting a drilling string having a drill bit on its lower end through a wellhead assembly mounted over hydrocarbon bearing strata. Blowout preventers are often mounted onto the wellhead assembly for shearing the drill string, or other tubular in the wellhead assembly, and sealing in the wellbore. Offshore drilling rigs normally employ a riser to connect the subsea wellhead with the drilling rig; where the blowout preventer is located at a lower end of the riser. Generally, blowout preventers include shear rams for shearing the drill string or tubular and pipe rams sized to close and seal around pipe strings of certain diameters.

Typically pipe shear rams have two rams with a blade mounted on an end of each ram. Hydraulically driven pistons are usually included to move the rams toward each other to shear pipe extending through the blowout preventer. Often, one of the blades is higher than the other and slides over the lower one when the shear rams close. The hardness of the tubular being sheared, in combination with the geometry of how the shear blades contact the tubular, requires that a significant force be applied to the shear blade to successfully shear the tubular.

SUMMARY OF THE INVENTION

Disclosed herein is an example of a method of shearing an oilfield tubular. In an embodiment the method includes engaging the tubular at two vertically spaced apart locations, exerting torsional forces on the tubular at the locations, and shearing the tubular by continuing to exert the forces on the tubular. In this example, the tubular may be inserted through a blowout preventer, and the torsional forces are exerted from the blowout preventer. In an example, engaging the tubular includes providing a tong device that has a generally U-shaped tong element pivotingly mounted on an end of a tong arm, and urging the tong device radially inward so that the tong element engages the tubular. In this example, exerting torsional forces on the tubular includes further urging the tong device radially inward to pivot the arm with respect to the tong element so that the tong element rotates with respect to an axis of the tubular. In an alternate example, engaging the tubular is done by providing a holding ram having a profiled surface, and projecting the holding ram radially inward into contact with the tubular. Exerting torsional forces on the tubular can involve providing a torque rack, and applying a tangential force on the tubular with the torque rack. Optionally, a single member can be used to exert a torsional force on the tubular at each of the locations.

Also disclosed herein is an example of a wellhead assembly that includes a housing, a bore selectively having a tubular inserted therein, and a torsional shearing device provided with the housing. In this example the torsional shearing device may be made up of a first unitary member that selectively exerts a first torsional force onto the tubular and a second unitary member that selectively exerts a second torsional force onto the tubular in a direction substantially opposite a direction that the first torsional force is exerted onto the tubular. The first and second unitary members can each have a tong assembly, wherein each tong assembly may be made up of a generally U-shaped tong member pivotingly mounted to a tong arm and grooves on an inner surface of each tong member, so that when the grooves of each tong member engage the tubular, the tong members pivot about their respective arms and rotate in opposite directions thereby exerting a shearing force onto the tubular. In an example, each of the first and second unitary members have elongated torque racks with grooves on surfaces facing the tubular, wherein the first and second unitary members selectively move into contact with an outer surface of the tubular along lines substantially tangential to the outer surface of the tubular. Optionally further included are holding rams that have a profiled surface for engaging the outer surface of the tubular and for providing a reactive holding force in response to forces applied to the tubular by engagement of the first and second unitary members. Alternatively, the torsional shearing device selectively applies a torsional force to the tubular and shears the tubular. The wellhead assembly may further include a blowout preventer, wherein the torsional shearing device is housed in the blowout preventer.

Further disclosed herein is a method of wellbore operations that includes applying a torque onto a tubular disposed through a wellhead assembly and shearing the tubular by continuing to apply the torque. In an alternate example, the step of applying the torque to the tubular comprises applying torsional forces onto the tubular at axially spaced apart locations. In an example of the method the torsional forces are in substantially opposite directions. Optionally, applying the torsional forces includes providing a single unitary member at the axially spaced apart locations and engaging the tubular with each of the single unitary members.

BRIEF DESCRIPTION OF DRAWINGS

Some of the features and benefits of the present invention having been stated, others will become apparent as the description proceeds when taken in conjunction with the accompanying drawings, in which:

FIG. 1B is a side perspective partial sectional view of the torsional shearing device of FIG. 1A shearing a tubular in accordance with the present invention.

FIG. 2 is a side perspective view of an alternate embodiment of the torsional shearing device of FIG. 1A in accordance with the present invention.

FIGS. 4A-4E are plan views of an example embodiment of a torsional shearing device shearing a tubular in accordance with the present invention.

Figure 1A:
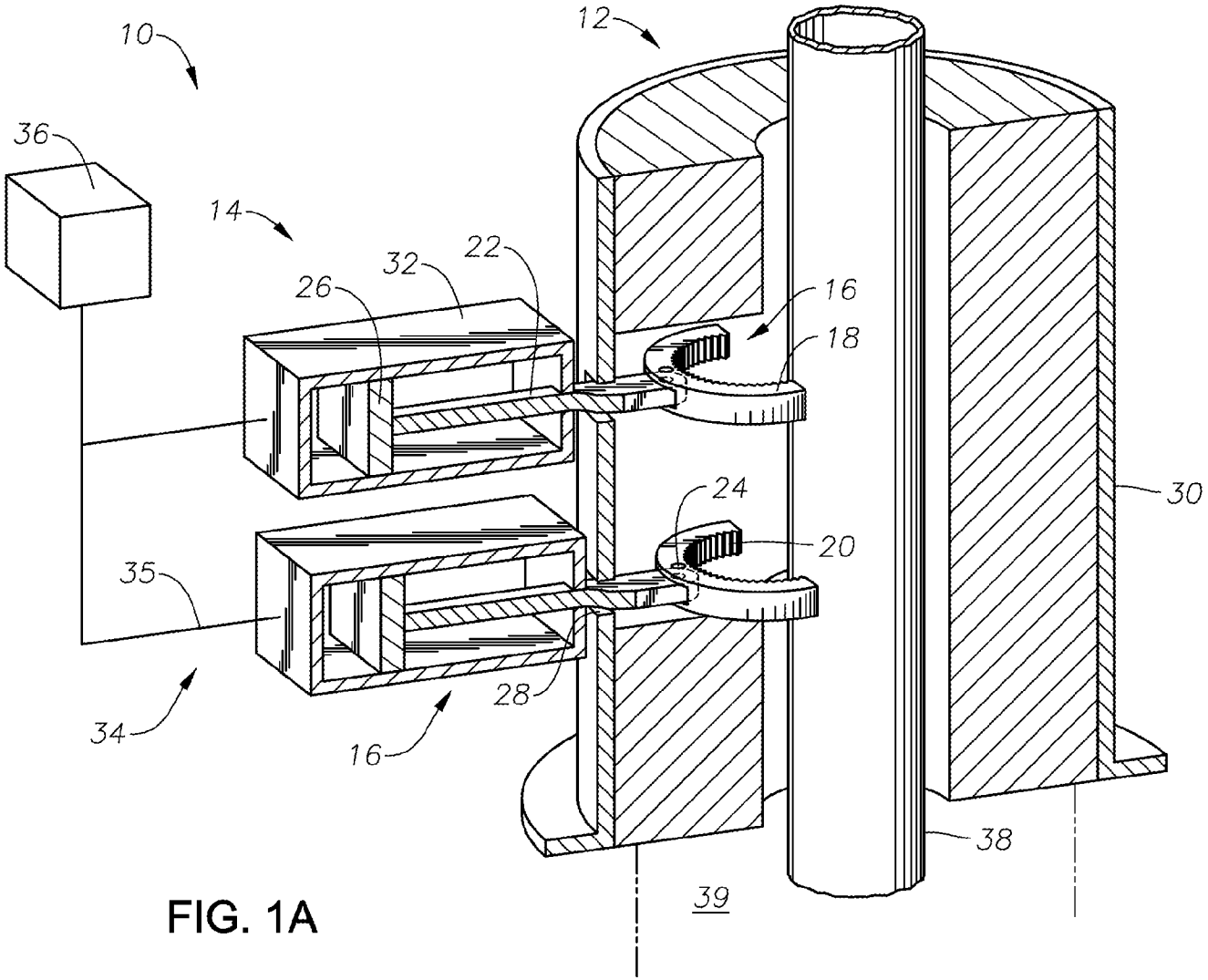
FIG. 1A is a side perspective partial sectional view of an example embodiment of a torsional shearing device in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example embodiment of a portion of a wellhead assembly 10 is shown in a side perspective view in FIG. 1A. In an example the wellhead assembly 10 can be subsea or one land. The portion of the wellhead assembly 10 shown includes a blowout preventer 12 having a torsional shearing system 14 that includes upper and lower tong assemblies 16. Provided with tong assembly 16 is a generally U-shaped tong member 18 having vertically oriented grooves 20 spaced apart at longitudinal locations along an inner surface of the tong member 18. A closed end, or base portion, of each tong member 18 pivotingly couples on an end of a respective elongated tong arm 22. Vertically disposed pins 24 insert through bores that extend axially through closed ends of each tong member 18 and ends of the tong arm 22 to connect the tong members 18 to the tong arms 22.

Further in the example of FIG. 1A are pistons 26 shown transversely mounted on ends of the tong arms 22 opposite where the tong arms 22 connect to the tong members 18. The tong arms 22 extend through openings 28 formed in a wall of a housing 30 of the blowout preventer 12. As will be described in more detail below, pressurizing selective sides of the pistons 26 reciprocates the tong arms 22 through the openings 28. The pistons 26 are schematically illustrated within respective cylinders 32; thus pressurizing selective sides of each piston 26 reciprocates the pistons 26 in a direction away from the side being pressurized. In the example of FIG. 1A, the pistons 26 and inner surfaces of the cylinders 32 are shown being substantially rectangular. However, the pistons 26 and cylinders 32 can also be circular or cylindrical.

A hydraulic circuit 34 is shown made up of hydraulic lines 35 that connect to the cylinder 32 and on opposite sides of the pistons 26. Opposite the connection to the cylinder 32 the lines 35 connect to a pressure source 36 for selectively delivering pressure to opposing sides of the piston 26. The pressure source 36 can be a pump that pressurizes fluid in the lines 35, and may be proximate the blowout preventer 12, distal from the blowout preventer 12, or above sea surface.

Still referring to FIG. 1A, a tubular 38 is illustrated coaxially disposed within the blowout preventer 12 that extends downward into a wellbore 39 beneath the wellhead assembly 10. Example tubulars include any tubular that can be disposed in a wellbore, including tubing, casing, or a drill string. As described above, in some instances, it is required that a tubular be sheared so that the wellbore 39 can be sealed in response to an overpressure condition within the corresponding wellbore 39. Referring now to FIG. 1B, an example of shearing the tubular 38 with the torsional shearing system 14 is shown in a side perspective view where the tong assemblies 16 are urged radially inwards into engagement with the tubular 38. Actuating the pressure source 36 and pressurizing a side of the piston opposite its connection with the tong arm 22 provides an urging force for motivating the tong assemblies 16. Continued radial inward movement of the tong assemblies 16 forces the open end of the tong members 18 into contact with the outer surface of the tubular 38. Further urging the tong arms 22 radially inward after the tong members 18 contact the tubular pivots the pinned connection between the tong members 18 and tong arms 22 thereby rotating the tong members 18 in a plane transverse to the axis $A_X$. As the grooves 20 on the inner surface of the tong members 18 grip the tubular 38, the tong members 18 transfer a torsional force to the tubular 38. In an alternate embodiment, the tong assemblies 16 are slightly offset from the axis $A_X$ of the tubular 38 so that the tong arms 22 are guided onto opposing sides of the tubular thereby twisting the tong members 18 in opposite directions. The twisting movement of the tong members 18 is illustrated by the arrows $A_1$, $A_2$ provided adjacent each of the tong members 18. Ultimately, the combined twisting forces applied by the tong assemblies 16 generate a torsional force in the tubular 38 between the tong members 18 that shears the tubular 38 to generate a fracture 40 shown in the tubular 38 between the tong members 18. In the example of FIG. 1B, the portion of the tubular 38 below the fracture 40 can be dropped into the wellbore 39 (FIG. 1A) thereby introducing a sufficient gap so that a ram (not shown), or other sealing device can extend across and seal the wellbore 39. In an example, the above described steps of shearing the tubular 30 can be in response to a condition in the wellbore 39, such as an overpressure, that necessitates shutting in and sealing the wellbore 39.

An alternative embodiment of a torsional shearing system 14A is shown in perspective view in FIG. 2. In this alternate example, the tong members 18A are elongate members that mount on ends of the tong arms 22 by a ball and socket arrangement 41. The ball and socket 41 connection allows the tong members 18A to pivot about the tong arms 22. Grooves 20 on the surface of the tong members 18A that face the tubular 38, can grip the tubular. Thus, by disposing the tong members 18A at different vertical positions and urging the tong arms 22 radially inward, a torsional force may be generated in the tubular 38 to produce a fracture 40 (FIG. 1B) for shearing the tubular 38.

Figure 3A:
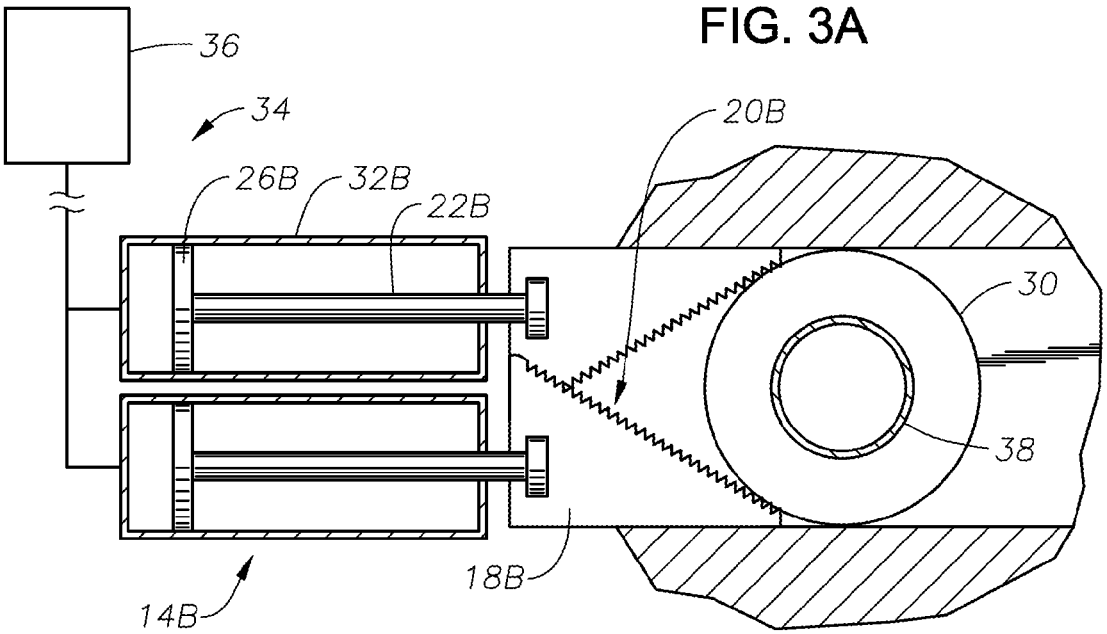
FIG. 3A is a plan view of an alternate embodiment of the torsional shearing device of FIG. 1A in accordance with the present invention.
Figure 3B:
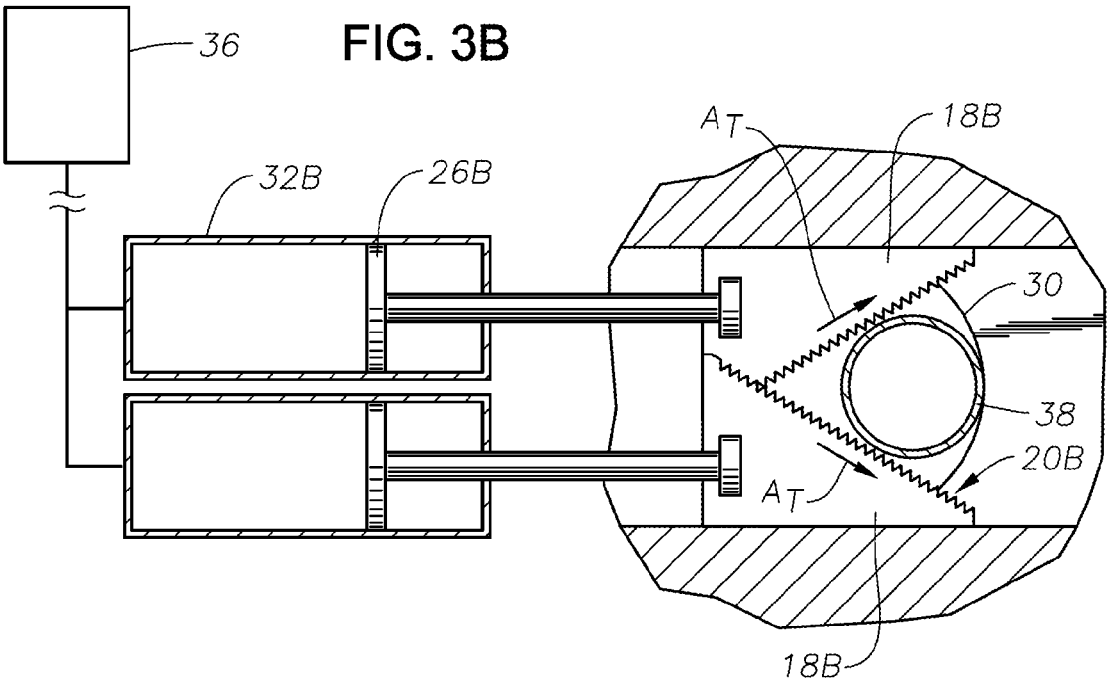
FIG. 3B is a plan view of the torsional shearing device of FIG. 3A shearing a tubular in accordance with the present invention.

FIGS. 3A and 3B illustrate an alternate example embodiment of a torsional shearing system 14B in a plan view. In this example, the tong members 18B have a generally triangular cross section, and a front surface for engaging an outer surface of the tubular 38 that is tangential to the tubular 38. Also in this example, the tong members 18B are vertically spaced apart, so that as illustrated in the example of FIG. 3B, a torsional force is produced in the tubular 38 between the tong members 18B. Each tong member 18B is driven by a tong arm 22B that in turn is driven by motivating piston 26B disposed in cylinder 32B. In the example of FIGS. 3A and 3B the pressure source 36 connects to the cylinder 32B for reciprocating the piston 26B within the cylinder 32B and driving the tong members 18B into contact with the tubular 38. As shown in FIG. 3B, the angled contact surface of the tong member 18B, in combination with grooves 20B tangentially engages the tubular 30 in the direction of the arrows $A_T$ that generates the respective torsional forces on the vertically spaced apart locations on the tubular 38. The amount of hydraulic force necessary in the pressure source 36 for generating the torsional forces necessary to create the fracture 40 is within the capabilities of those skilled in the art.

FIGS. 4A through 4E schematically illustrate an alternative example of a torsional shearing system 42 that includes a generally planar holding ram 44 that has a profiled front surface 46 shown facing the corresponding tubular 38. A middle portion of the profiled front surface 46 angles inward away from the axis $A_X$ to resemble a V-shaped surface. Grooves 48 are disposed along the length of the front surface 46 and in a generally vertical direction, so that when the holding ram 44 contacts the tubular 38 the front surface 46 can grip the tubular 38. Further illustrated in the schematic plan view of FIG. 4A is a circular seal 50 mounted on an upper surface of the holding ram 44. Optionally, the seal 50 may be provided to engage a lower facing surface (not shown) of the wellhead assembly 10 or blowout preventer 12 (FIG. 1A) and generate a pressure seal between the holding ram 44 and wellhead assembly 10 or blowout preventer 12. An elongate torque rack 52 is further illustrated in FIG. 4A shown set adjacent an outer periphery of the blowout preventer housing 30 and oriented along a path tangent to the circular housing 30. Sequentially illustrated in FIGS. 4A through 4E, the holding ram 44 moves radially inward over the wellbore 39 (FIG. 1A) so that the front surface 46 contacts the outer periphery of the tubular 38. Referring to FIG. 4C, the holding ram 44 has urged the tubular 38 past the axis $A_X$ of the wellhead assembly and against the inner surface of the housing 30 and proximate the torque rack 52. In FIG. 4D, the torque rack 52 is shown having been moved laterally so that its side is in contact with the tubular 38, laterally moving the torque rack 52 as shown rotates the tubular 38. Optional grooves 54 may be provided on the surface of the torque rack 52 that contacts the tubular 38 to enhance gripping and frictional contact between these two members. More than one holding ram 44 and/or torque rack 52 may be included in the embodiment of FIGS. 4A through 4E to facilitate shearing of the tubular during this sequence. In examples where more than one ram 44 and/or rack 52 is included, the rams 44 and/or racks 52 can be at different vertical locations. Actuating the holding ram 44 and/or torque rack 52 can be done an actuating means that is the same or similar to the piston 26 and cylinder 32 of FIG. 1A. Referring now to FIG. 4E, the tubular is shown having been sheared and the holding ram 44 inserted within the wellbore and creating a pressure seal therein. In one example, by positioning the seal 50 on an upper surface of the holding ram 44, fluid pressure from the wellbore below the holding ram upwardly urges the holding ram thereby energizing seal 50 and ensuring a pressure barrier within the wellbore by the holding ram 44.

Figure 5A:
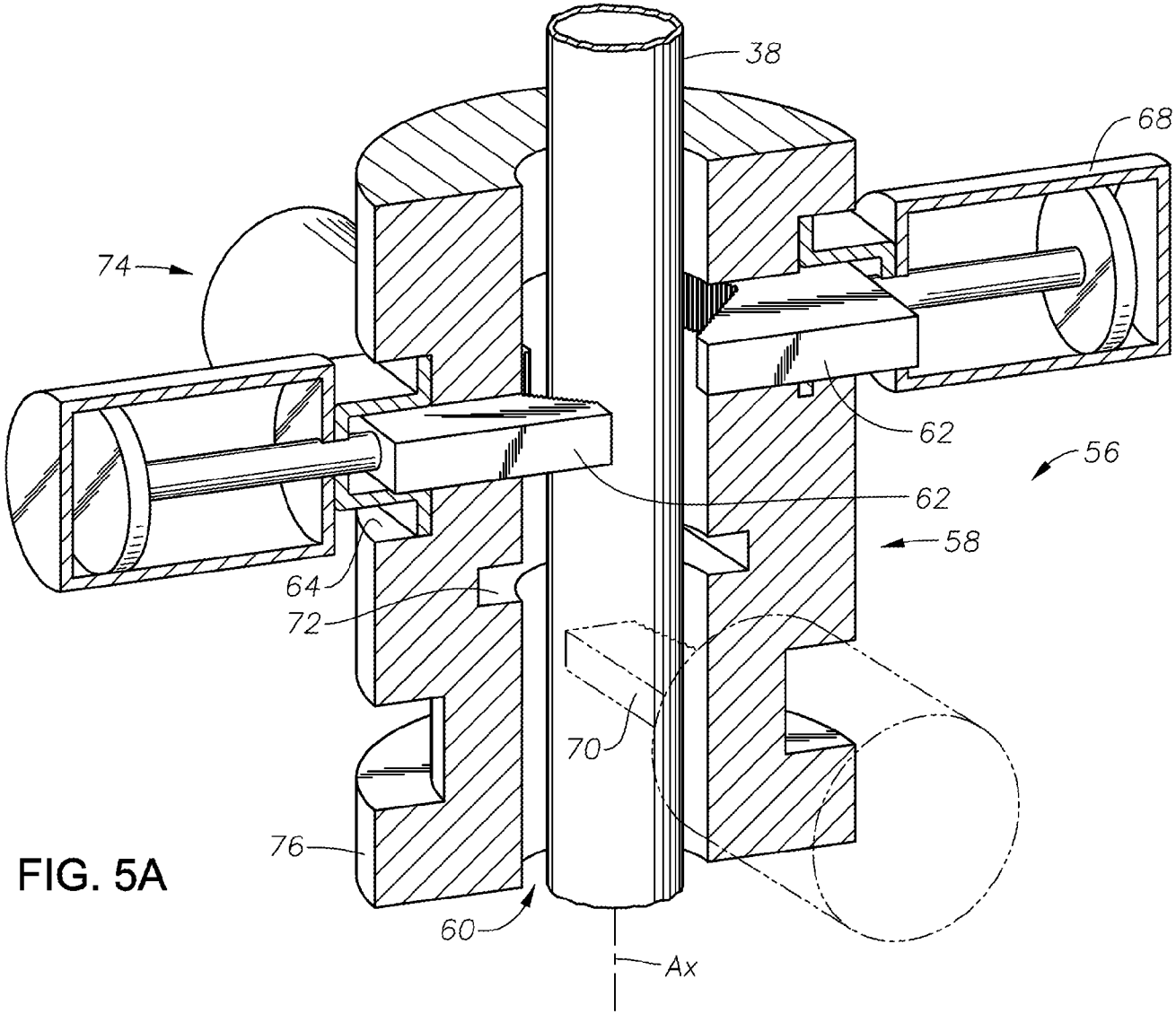
FIG. 5A is a side perspective view of an example embodiment of a torsional shearing device shearing a tubular in accordance with the present invention.
Figure 5B:
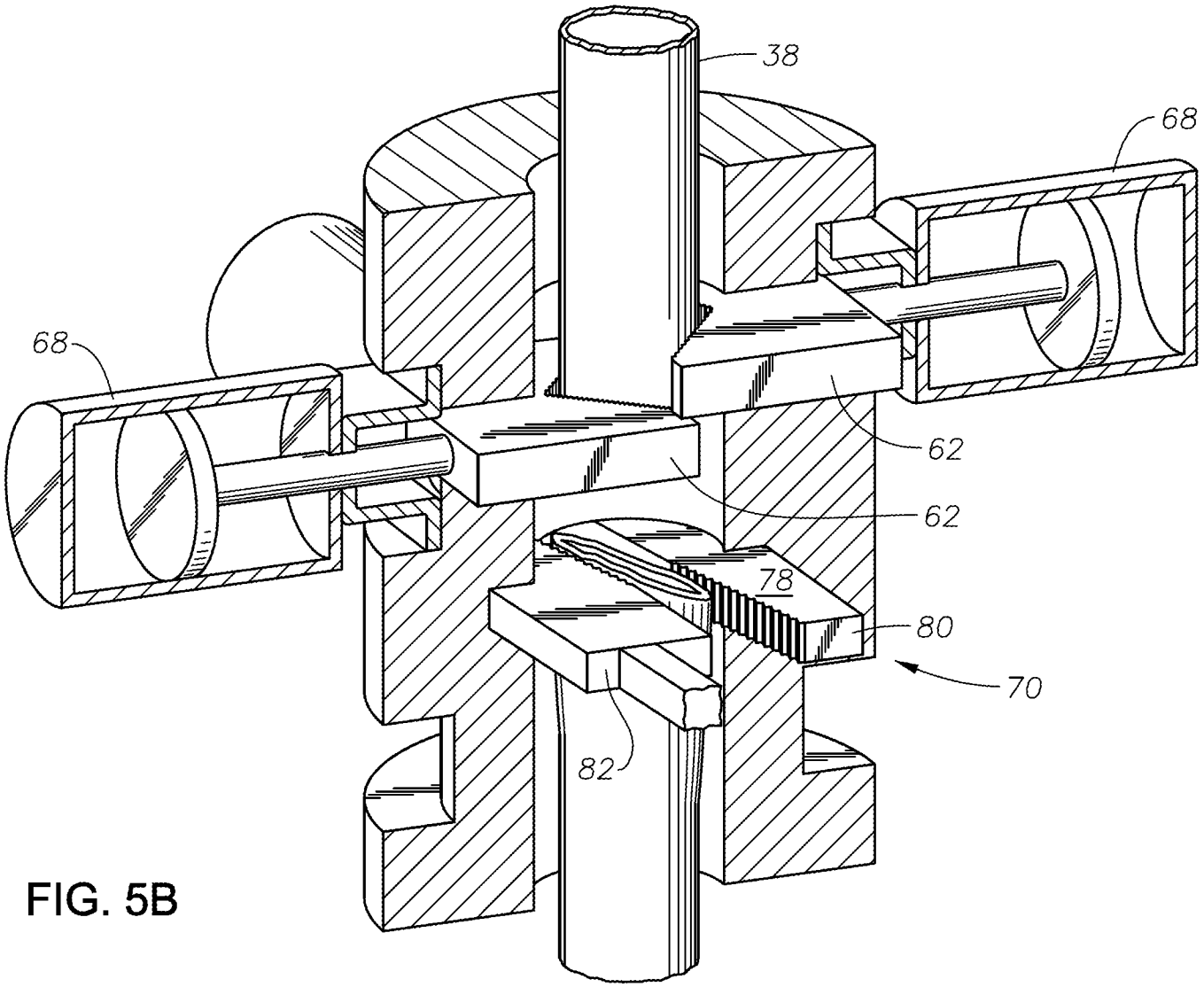
FIG. 5B is a side perspective view of the torsional shearing device of FIG. 5A shearing a tubular in accordance with the present invention.

FIGS. 5A and 5B illustrate operation of another alternative embodiment of a wellhead assembly 56 having a blowout preventer 58. In this example, the blowout preventer 58 is a generally annular member, having a bore 60 extending axially through its body. A pair of generally planar rams 62 are shown disposed within the body of the blowout preventer 58 and within slots 64 that project radially through the body of the blowout preventer 58. Each of the rams 62 have a profiled surface that faces radially inward towards the tubular 38; where the profiled surfaces slope into the body of the rams 62 proximate the mid portion of the ram 62 to resemble a V-shaped surface. Optional grooves 66 extend vertically on the front surface of the rams 62 that faces the tubular 38. Opposite the side that is profiled, actuators 68 are mounted on the blowout preventer 58 for reciprocating the rams 62 within the slot 64. Further illustrated in FIG. 5A are a pair of elongate and planar torque racks 70 that each have a front surface 71 facing the tubular 38. The front surfaces 71 extend at an angle with the axis $A_X$ of the wellhead assembly and blowout preventer 58. Slots 72 are provided within the body of the blowout preventer that are generally transverse to slots 62 and at vertically spaced apart locations within the blowout preventer 58. An actuator 74 is shown mounted on the body of the blowout preventer 58 for providing actuation to the torque racks 70. Optionally, a flange 76 is formed on a lower end of the body of the blowout preventer 58 for mounting onto a wellhead housing or other portion of a wellhead assembly (now shown).

Referring now to FIG. 5B, the rams 62 have been moved radially inward by their respective actuators 68 thereby engaging the tubular 38. The sloping front surfaces 71 of the torque racks 70 create a forward end 80 having a reduced width over that of a rearward end 82 of the torque rack 70. Thus, urging the torque rack 70 in a direction tangential to the tubular 38, with the forward end 80 at the leading edge of direction, transfers a torque onto the tubular 38 by each of the torque racks 70. The combined torsion ultimately overcomes the strength in the tubular 38 thereby fracturing the tubular 38 into upper and lower sections as shown in FIG. 5B. By retracting the torque racks 70 into their position of FIG. 5A, the lower portion of the tubular 38 can be dropped into the wellbore so that a seal can be introduced into the wellbore 39 (FIG. 1A) and prevent egress of flow from within the wellbore 39.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of shearing an oilfield tubular comprising:

engaging the tubular at two vertically spaced apart locations;

exerting torsional forces on the tubular at the locations; and shearing the tubular by continuing to exert the forces on the tubular;

wherein the torsional forces rotate the tubular around the longitudinal axis of the tubular until the tubular shears.

2. The method of claim 1, wherein the tubular is inserted through a blowout preventer, and the torsional forces are exerted from the blowout preventer.

3. The method of claim 1, wherein the step of engaging the tubular comprises providing a tong device that includes a generally u-shaped tong element pivotingly mounted on an end of a tong arm and urging the tong device radially inward so that the tong element engages the tubular.

4. The method of claim 3, wherein the step of exerting torsional forces on the tubular comprises further urging the tong device radially inward to pivot the arm with respect to the tong element so that the tong element rotates with respect to an axis of the tubular.

5. The method of claim 1, wherein the step of engaging the tubular comprises providing a holding ram having a profiled surface, and projecting the holding ram radially inward into contact with the tubular.

6. The method of claim 5, wherein the step of exerting torsional forces on the tubular comprises providing a torque rack, and applying a tangential force on the tubular with the torque rack.

7. The method of claim 1, wherein a single member exerts the torsional forces on the tubular at each of the locations.

8. A wellhead assembly comprising:

a housing;

a bore selectively having a tubular inserted therein; and a torsional shearing device provided with the housing comprising, a first unitary member that selectively exerts a first torsional force onto the tubular in a first direction, and a second unitary member that selectively exerts a second torsional force onto the tubular in a second direction substantially opposite the first direction;

wherein the first torsional force turns the tubular around the longitudinal axis of the tubular in a first direction, and the second torsional force turns the tubular around the longitudinal axis of the tubular in a second direction until the tubular shears.

9. The wellhead assembly of claim 8, wherein the first and second unitary members each comprise a tong assembly, wherein each tong assembly is made up of a generally u-shaped tong member pivotingly mounted to a tong arm and grooves on an inner surface of each tong member, so that when the grooves of each tong member engage the tubular, the tong members pivot about their respective arms and rotate in opposite directions thereby exerting a shearing force onto the tubular.

10. The wellhead assembly of claim 8, wherein each of the first and second unitary members comprise elongate torque racks having grooves on surfaces facing the tubular, wherein the first and second unitary members selectively move into contact with an outer surface of the tubular along lines substantially tangential to the outer surface of the tubular.

11. The wellhead assembly of claim 10 further comprising, holding rams having a profiled surface for engaging the outer surface of the tubular and for providing a reactive holding force in response to forces applied to the tubular by engagement of the first and second unitary members.

12. The wellhead assembly of claim 8, further comprising a blowout preventer, wherein the torsional shearing device is housed in the blowout preventer.

13. A method of wellbore operations comprising:

applying a torque onto a tubular disposed through a wellhead assembly; and shearing the tubular by continuing to apply the torque;

wherein the torque applied to the tubular rotates the tubular around the longitudinal axis of the tubular until the tubular shears.

14. The method of claim 13, wherein the step of applying the torque to the tubular comprises applying torsional forces onto the tubular at axially spaced apart locations.

15. The method of claim 14, wherein the torsional forces are in substantially opposite directions.

16. The method of claim 14, wherein the step of applying the torsional forces comprises providing a single unitary member at the axially spaced apart locations and engaging the tubular with each of the single unitary members.

* * * * *